US008193728B2

(12) United States Patent
Kästle

(10) Patent No.: US 8,193,728 B2
(45) Date of Patent: Jun. 5, 2012

(54) CIRCUIT ARRANGEMENT AND METHOD FOR OPERATING A HIGH-PRESSURE DISCHARGE LAMP

(75) Inventor: Herbert Kästle, Traunstein (DE)

(73) Assignee: OSRAM AG, München (DE)

( * ) Notice: Subject to any disclaimer, the term of this patent is extended or adjusted under 35 U.S.C. 154(b) by 410 days.

(21) Appl. No.: 12/522,889

(22) PCT Filed: Jan. 10, 2007

(86) PCT No.: PCT/EP2007/050205

§ 371 (c)(1),
(2), (4) Date: Jul. 10, 2009

(87) PCT Pub. No.: WO2008/083852

PCT Pub. Date: Jul. 17, 2008

(65) Prior Publication Data

US 2010/0013407 A1 Jan. 21, 2010

(51) Int. Cl.
*H05B 41/36* (2006.01)

(52) U.S. Cl. ..... 315/291; 315/224; 315/308; 315/209 R; 315/247

(58) Field of Classification Search ..... 315/224, 315/307, 291, 151, 225, 209 R, 247, 219
See application file for complete search history.

(56) References Cited

U.S. PATENT DOCUMENTS 5,569,984 A * 10/1996 Holtslag ..... 315/307
5,952,794 A * 9/1999 Bergman et al. ..... 315/307
6,459,214 B1 * 10/2002 Chen et al. ..... 315/247
6,489,731 B1 12/2002 Bruning et al.
6,788,007 B2 9/2004 Krämer
6,919,696 B2 * 7/2005 Van Casteren ..... 315/291
7,145,293 B2 * 12/2006 Braun et al. ..... 315/224
7,170,235 B2 * 1/2007 Van Casteren ..... 315/224
(Continued)

FOREIGN PATENT DOCUMENTS

EP 1 501 338 A2 1/2005
(Continued)

*Primary Examiner* — Vibol Tan
(74) *Attorney, Agent, or Firm* — Cozen O'Connor

(57) ABSTRACT

A circuit arrangement for operating a high-pressure discharge lamp, comprising at least one first electronic switch and one second electronic switch in a half-bridge arrangement; a supply voltage terminal for supplying the half-bridge arrangement with a DC voltage signal; a load circuit, which comprises a lamp inductor and is coupled firstly to the half-bridge center point and secondly to at least one terminal for connecting the high-pressure discharge lamp; a drive circuit for providing at least one first and one second drive signal for the first electronic switch and the second electronic switch, the drive circuit being adapted to provide the first and the second drive signal in such a way that the clock thereof is firstly swept between a first and a second frequency; wherein the drive circuit is furthermore adapted to modulate the first and the second drive signal with a predeterminable third frequency, with the modulation with the predeterminable third frequency being single-tone frequency modulation, with the result that, in the amplitude spectrum of the first and the second drive signal, at least one first, one second and one third spectral line appear, the first spectral line corresponding to the instantaneous frequency of the swept clock, and the second and the third spectral lines, in terms of absolute value, appearing at an interval with respect to the predeterminable third frequency, symmetrically with respect to the first spectral line, and that, in the power spectrum of the signal, at the terminal for connecting the high-pressure discharge lamp, a spectral line at the predeterminable third frequency results.

13 Claims, 11 Drawing Sheets

U.S. PATENT DOCUMENTS

Figure 1:
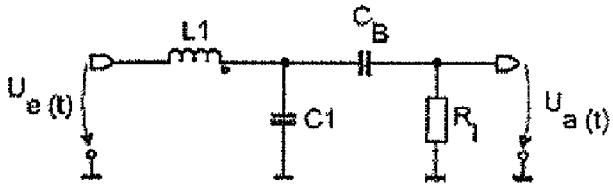

| | | | | |
|---|---|---|---|---|
| 7,388,335 | B2 * | 6/2008 | Kastle | 315/209 R |
| 2003/0117086 | A1 | 6/2003 | Kramer | |

FOREIGN PATENT DOCUMENTS

| | | | |
|---|---|---|---|
| EP | 1 560 472 | A | 8/2005 |
| EP | 1 729 324 | A | 12/2006 |
| WO | WO 02/30162 | A | 4/2002 |
| WO | WO 03/017736 | A1 | 2/2003 |
| WO | WO 03/024161 | B1 | 3/2003 |
| WO | WO 2003024161 | A1 | 3/2003 |

* cited by examiner

CIRCUIT ARRANGEMENT AND METHOD FOR OPERATING A HIGH-PRESSURE DISCHARGE LAMP

RELATED APPLICATIONS

This is a U.S. national stage of application No. PCT/EP2007/050205, filed on Jan. 10, 2007.

FIELD OF THE INVENTION

The present invention relates to a circuit arrangement and method for operating a high-pressure discharge lamp.

BACKGROUND OF THE INVENTION

Such a circuit arrangement and such a method are known from EP 1 501 338 A2, in relation to which more details are given further below.

In order to operate a high-pressure discharge lamp, generally a sinusoidal AC operating voltage is required, whose frequency is swept in saw-tooth fashion in the range between 45 kHz and 55 kHz, usually with a 100 Hz clock, depending on the geometry of the high-pressure discharge lamp. The sweep operation generally prevents the permanent excitation of acoustic resonances and in addition contributes to the stabilization of the plasma arc (arc straightening).

In the case of high-efficiency metal halide lamps, the AC operating voltage should at the same time be amplitude-modulated in addition to the sweep operation in order to improve mixing of the fill, wherein the modulation should likewise be capable of being set corresponding to the geometry of the high-pressure discharge lamp, in particular of the lamp burner, both in terms of frequency, typically from 23 kHz to 30 kHz, and in terms of modulation depth, typically from 10% to 40%. The amplitude modulation in this case is used for targeted excitation of a special longitudinal acoustic resonance in the plasma arc which, with its property as the longitudinal mode, leaves the burning response of the plasma arc with respect to its stability unimpaired, but in addition brings about increased mixing of the gas components in the combustion chamber. This is known appropriately as color mixing. The amplitude modulation firstly results, in particular in the case of vertical operation, in a more homogeneous luminance along the plasma arc and secondly also in a considerable increase in luminous efficiency.

When using an inverter in a half-bridge arrangement for coupling the high-pressure discharge lamp to an electronic ballast, it is generally difficult to apply the amplitude modulation at this point. The amplitude modulation was therefore applied to the supply voltage of the half-bridge via a separate preliminary stage in the prior art, cf. in this regard DE 10 2005 028 4127.5. In terms of circuitry complexity, this requires at least one inductor and one or two electronic switches.

When using an inverter in a full-bridge arrangement for coupling the lamp to the electronic ballast, the amplitude modulation can generally be produced by phase modulation when driving the opposite corresponding electronic switches, as is described in EP 1 501 338, for example. In addition to the complexity involved in terms of two additional electronic switches for implementing an inverter in a full-bridge arrangement, this implementation has the disadvantage that the load circuit needs to be tuned to a sufficient depth for so-called zero-voltage switching to be capable of being maintained at relatively high inactive dead times in order to protect the field effect transistors, which are usually used as electronic switches. In addition, when using an inverter in a full-bridge arrangement, the lamp needs to be separated from the electronic ballast via a transformer owing to the steep edges at both outputs for reasons of EMC in order that only the harmonic differential signal now passes to the outside on the two lamp lines.

SUMMARY OF THE INVENTION

One object of the present invention is to provide the circuit arrangement mentioned above or the method mentioned above in such a way that it is possible for the amplitude modulation to be applied with reduced complexity, whereby at the same time the use of an inverter in a half-bridge arrangement should be provided.

The invention takes advantage of the knowledge that amplitude modulation of the drive signal for the high-pressure discharge lamp can be produced in principle using frequency modulation at the input of an inverter in a half-bridge arrangement. As a result, the separate preliminary modulation stage, which has already been mentioned in connection with the prior art and is required in said prior art, can be dispensed with, which results in a considerable reduction in component parts, which has an advantageous effect both in terms of the space required and in terms of the efficiency and the implementation costs.

Figure 6:
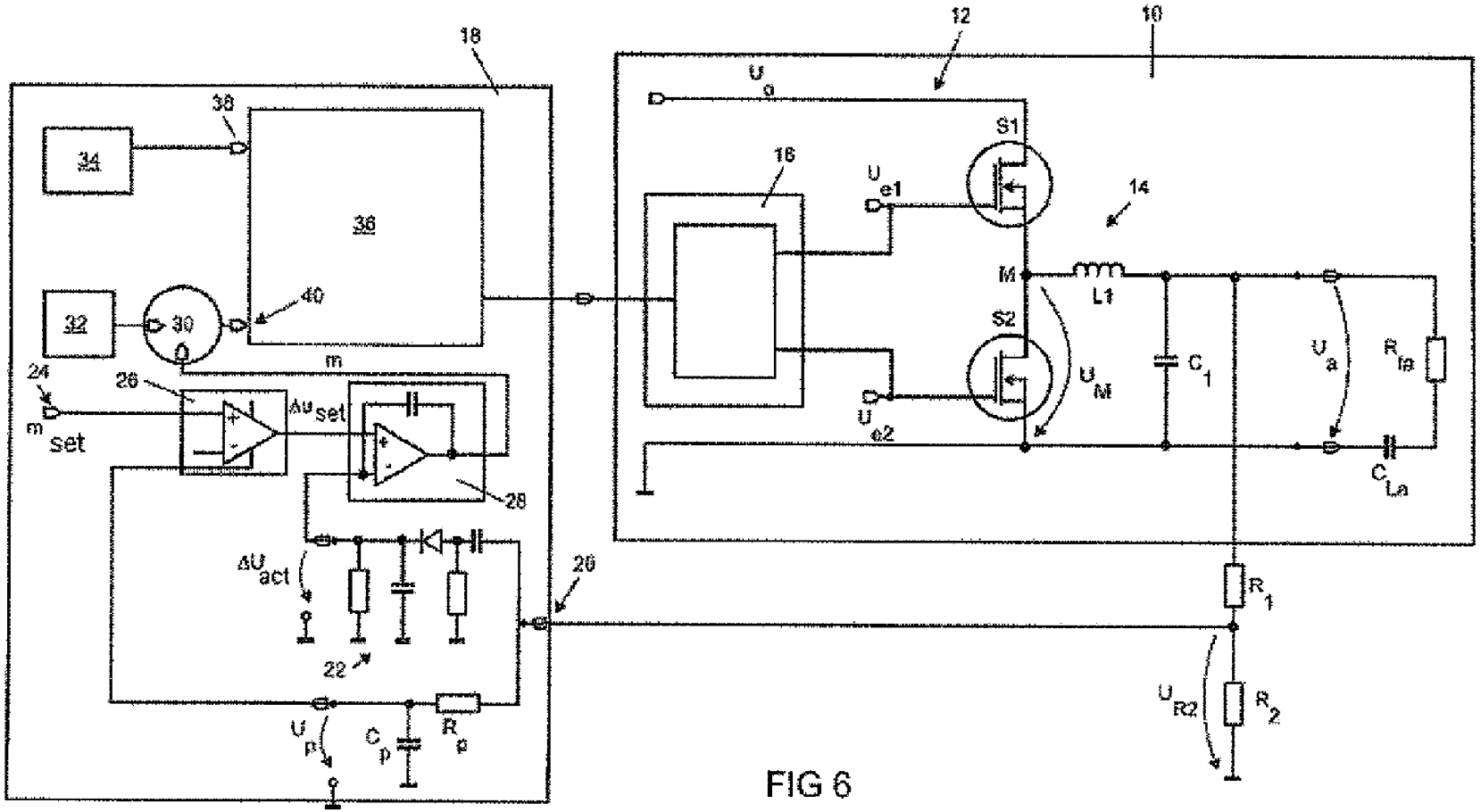

The present invention therefore follows a different path than EP 1 501 338 cited above. Although the explanation of features of the invention provided below can be understood to mean that the drive circuit is designed in such a way that the clock of the drive signals is swept between a first and a second frequency, and that the pulse width and/or phase thereof is modulated with a predetermined third frequency, in this regard it should be stated that, although the pulse width is varied therein, this is effected within a cycle, with the result that in each case the period duration and conversely the operating frequency always remain the same. There is therefore no frequency modulation which has been quantified with the third frequency (obviously apart from the slow sweep adjustment). Pulse width modulation as illustrated in FIG. 6 of said document at a constant carrier frequency can only bring about an amplitude modulation effect in a full-bridge arrangement. In the full-bridge arrangement, in this case the dual pairs are in each case supplied to the electronic switches, which are positioned diagonally with respect to one another. In a half-bridge arrangement, as is the aim of the present invention, this procedure does not give the desired result since, in the case of a half-bridge, the upper and the lower switches necessarily need to be operated in complementary fashion within the cycle without a relatively long dead time and, with this boundary condition, the required spectral purity of the amplitude modulation cannot be provided. In particular, it is not possible for sinusoidal amplitude modulation to be produced and a mixture of a plurality of modulation frequencies was always obtained for system-related reasons.

As regards the implementation with phase modulation as described in the mentioned document, mention should be made of the fact that in this case two clock signals which are inverted with respect to one another and with a constant operating frequency are provided for driving the opposite branches of the full-bridge, with the phase angle of the two mutually opposite clock signals being shifted with respect to one another with the clock timing of the third frequency in order to produce an amplitude modulation effect. Which of the two clock signals remains temporally fixed in the process, or whether both clock signals are in each case temporally shifted with respect to a fixed period of time, is entirely irrelevant since only the relative shift with respect to one another has an effect.

The fact that the transient action of the phase shift also entails a frequency shift effect is irrelevant for the application in a full-bridge arrangement since after all the aim is the shift which entails the desired amplitude modulation effect.

In the present invention, from the beginning the aim is not an effect which is based on pulse width modulation for varying the output power via a step-down converter circuit or phase shift modulation of two drive signals for varying the output power via a full-bridge arrangement since this effect, as has already been mentioned, can only result in this aim in these circuit arrangements for the spectrally pure operation of a high-efficiency lamp.

In the present invention, the aim is instead an effect which can be achieved owing to frequency modulation via a single drive signal for the inverter in a half-bridge arrangement. As is readily apparent to a person skilled in the art, the first and the second drive signal for the first and the second switches of the half-bridge arrangement are produced from a single drive signal for the inverter generally in a half-bridge driver, with the first and the second drive signal always being complementary with respect to one another. The signal produced at the half-bridge center point, in particular a square-wave signal, is in this case exactly the same in terms of shape as the drive signal at the input of the inverter, i.e. at the input of the half-bridge driver. In the case of frequency modulation, the operating frequency is modulated sinusoidally with the clock timing of the modulation frequency, i.e. the third frequency. In this case again no account is taken of the sweep adjustment. The operating frequency is therefore temporally varied, and therefore has a continuously changing instantaneous value and is only constant in terms of its mean value, corresponding to its nominal value. This frequency modulation produces the desired operating signal with amplitude modulation at the lamp once the higher-order harmonics have been filtered out at the load circuit.

In a first embodiment, the drive circuit is designed to carry out the modulation with the predeterminable third frequency in such a way that, in the amplitude spectrum of the first and the second drive signal, at least one first, one second and one third spectral line appear, the first spectral line corresponding to the instantaneous frequency of the swept clock, and the second and the third spectral lines, in terms of absolute value, appearing at an interval with respect to the predeterminable third frequency, symmetrically with respect to the first spectral line.

In this case, it is preferred if the phase angle of the signal in the case of the second and in the case of the third spectral line is such that, in the amplitude spectrum of the signal, at the half-bridge center point, no spectral line at the predeterminable third frequency results.

Furthermore, it is preferred if, in this case, the load circuit is in the form of a resonant circuit in such a way that, in the power spectrum, at the terminal for connecting the high-pressure discharge lamp when the high-pressure discharge lamp is connected, a spectral line at the predeterminable third frequency results. In general, the drive circuit is designed to carry out frequency modulation of the clock, which is swept between the first and the second frequency, with the third predeterminable frequency.

In order to achieve this frequency modulation, in principle three different variants are proposed:

In a first variant, the drive circuit comprises a pulse width modulation module, whose clock input is coupled to a source for the clock which is swept between the first and the second frequency, and whose modulation input is coupled to a source for the signal at the third frequency, the drive circuit being designed to modulate the pulse width of the signal which is swept between the first and the second frequency as a function of the signal at the third frequency, in particular as a function of an instantaneous value of the signal at the third frequency.

Preferably, in this case the drive circuit is designed to modulate the pulse width of the clock which is swept between the first and the second frequency as a function of an instantaneous value of the signal at the third frequency in such a way that, at predeterminable times, in particular at times with an equidistant time interval, the instantaneous value of the signal at the third frequency is determined and, corresponding to the determined instantaneous value, the instantaneous pulse width of the swept clock is lengthened or shortened.

In this case it can be provided that, in the first and in the second drive signal, both the rising edge and the pulse center are shifted with the clock timing of the third frequency with respect to the unmodulated clock which is swept between the first and the second frequency.

In the second proposed variant, the drive circuit comprises a phase shift module, whose clock input is coupled to a source for the clock which is swept between the first and the second frequency, and whose modulation input is coupled to a source for the signal at the third frequency, the drive circuit being designed to shift the start edge and the end edge of the signal which is swept between the first and the second frequency as a function of the signal at the third frequency, in particular as a function of an instantaneous value of the signal at the third frequency.

In a third variant, the drive circuit comprises a phase shift module and a pulse width modulation module, with the drive circuit being designed first to shift the start edge as a function of the signal at the third frequency in the clock signal which is swept between the first and the second frequency and then in the same way to shift the position of the original pulse center likewise as a function of the signal at the third frequency.

Preferably, the clock frequency is below 150 kHz, preferably between 30 and 90 kHz, particularly preferably between 40 and 60 kHz.

Preferably, the third frequency is below 50 kHz, preferably between 20 and 35 kHz. Preferably, the sweep frequency is between 50 Hz and 500 Hz, preferably between 80 Hz and 200 Hz.

As has already been mentioned, the aim of the present invention consists inter alia in making it possible to implement a circuit arrangement with which the application of amplitude modulation to the operating voltage of the high-pressure discharge lamp using an inverter with two electronic switches in a half-bridge arrangement is made possible.

Nevertheless, it is optionally possible, in particular if a relatively high lamp running voltage makes it necessary, to furthermore provide a third and a fourth electronic switch, the first, the second, the third and the fourth electronic switches being connected in a full-bridge arrangement, and the drive circuit being designed to also provide the drive signals for the third and the fourth electronic switches corresponding to the drive signals for the first and the second electronic switches, in particular in complementary fashion. In this case, owing to the largely constant duty factor of 50%, the freewheeling condition for the zero-voltage switching is also uncritical for relatively high degrees of modulation.

The preferred embodiments mentioned with reference to the circuit arrangement according to the invention and the advantages thereof apply correspondingly, so far as appropriate, to the method according to the invention.

BRIEF DESCRIPTION OF THE DRAWING(S)

Figure 2A:
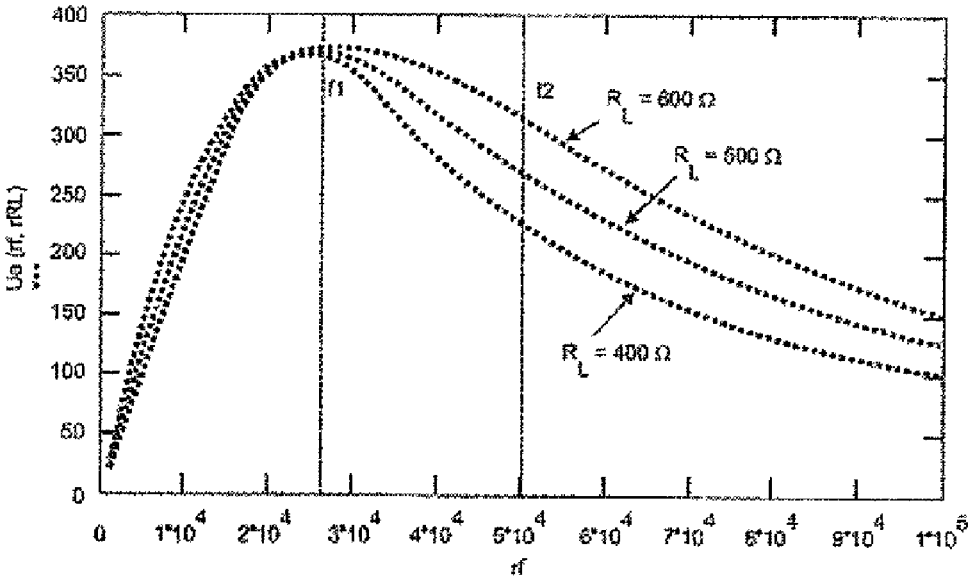
Figure 2B:
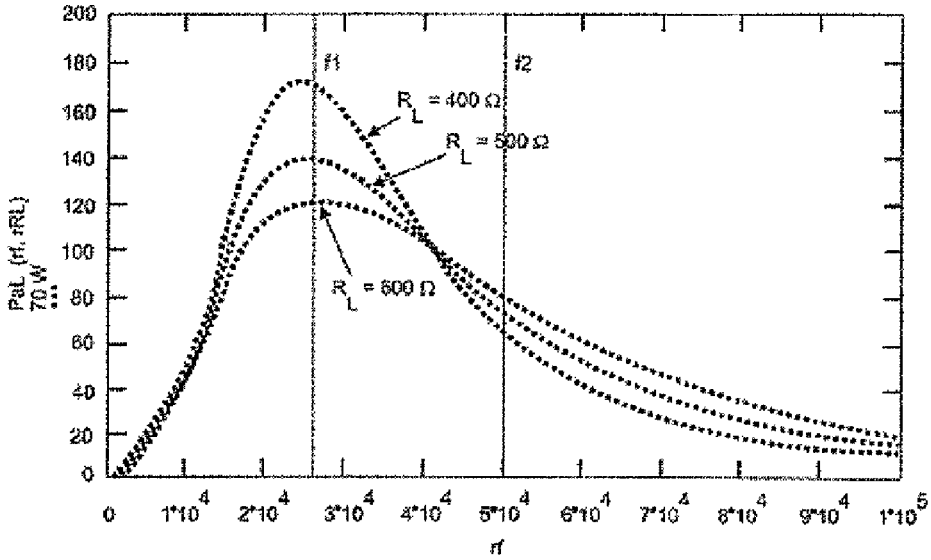
Figure 2C:
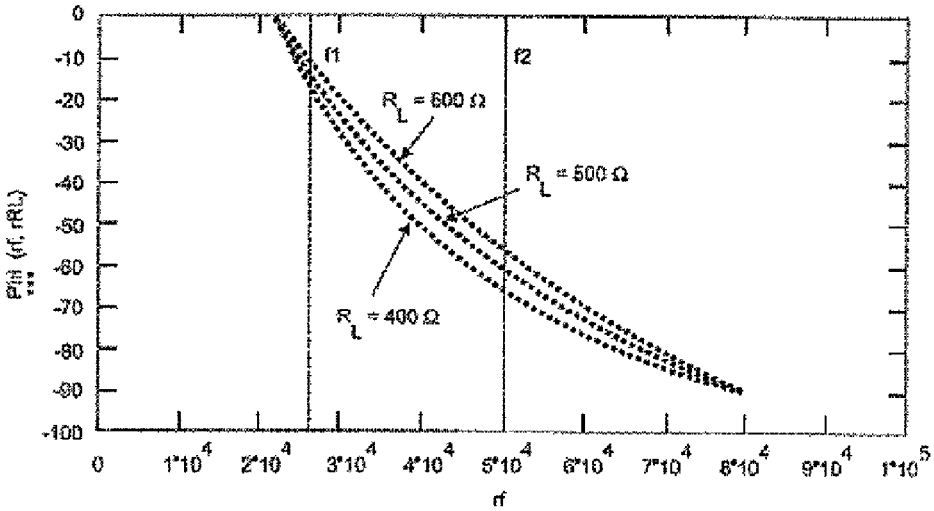
Figure 3A:
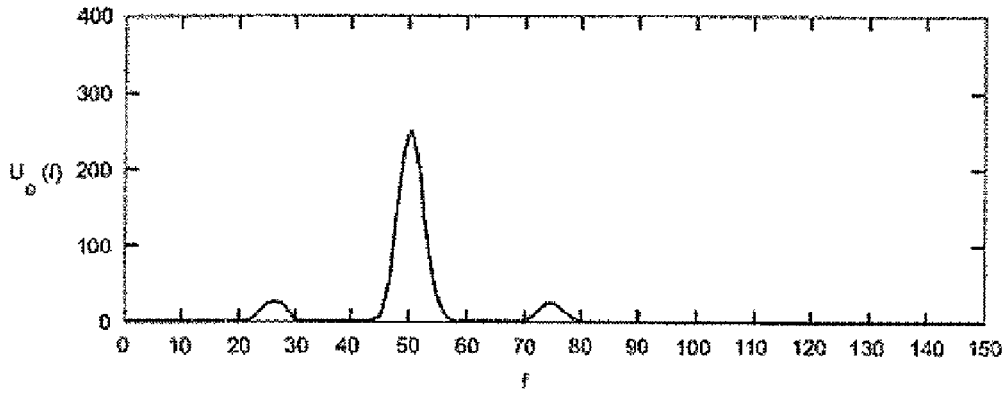
FIG 3a (Prior art)
Figure 3B:
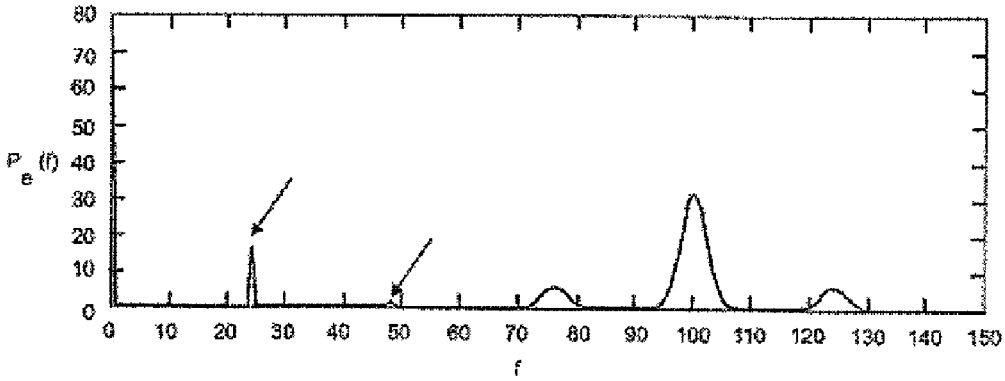
FIG 3b (Prior art)
Figure 4A:
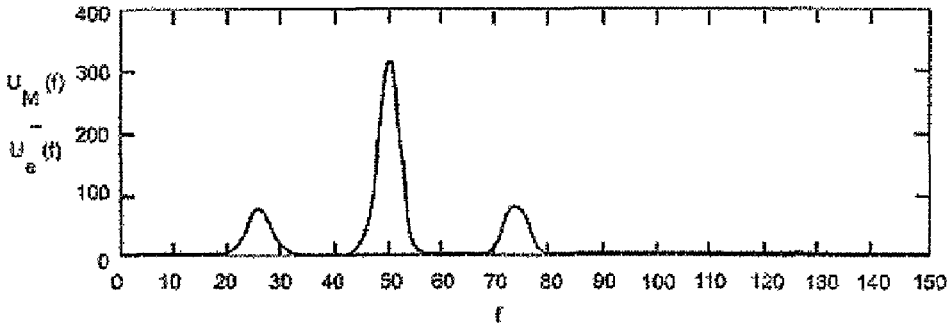
Figure 4B:
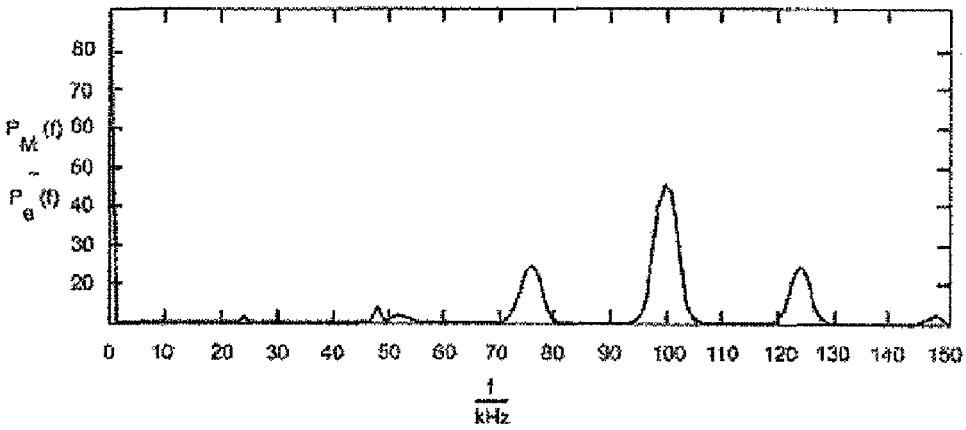
Figures 4C, 4D, 4E:
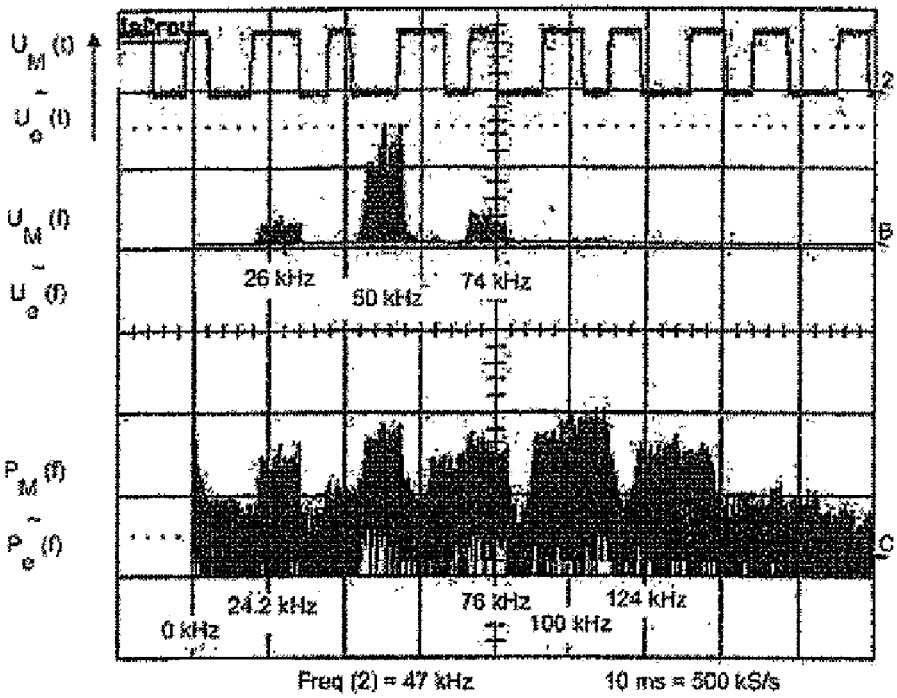
Figure 5A:
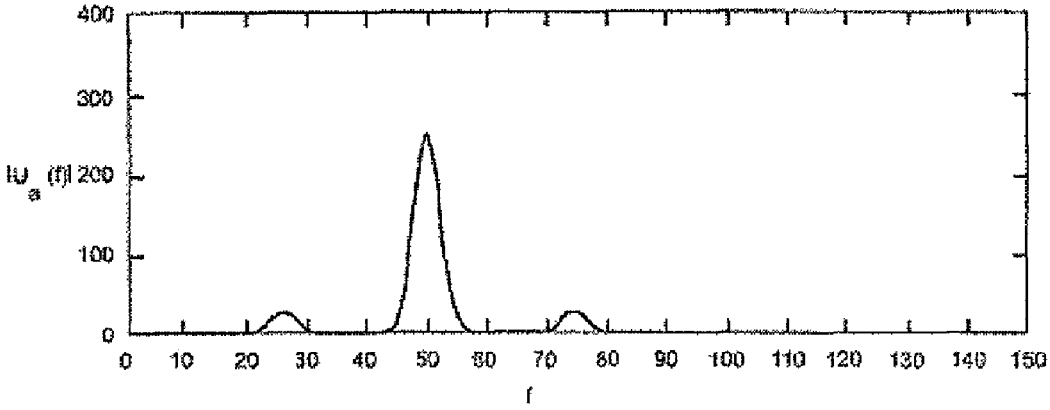
Figure 5B:
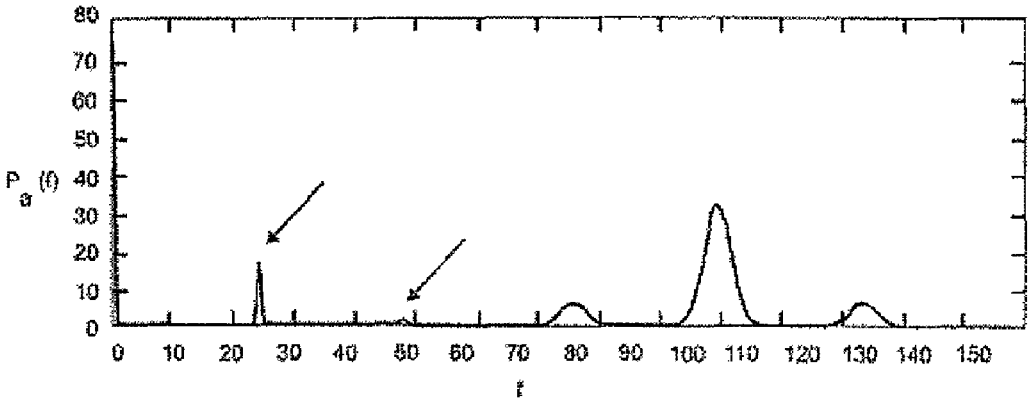
Figure 7A:
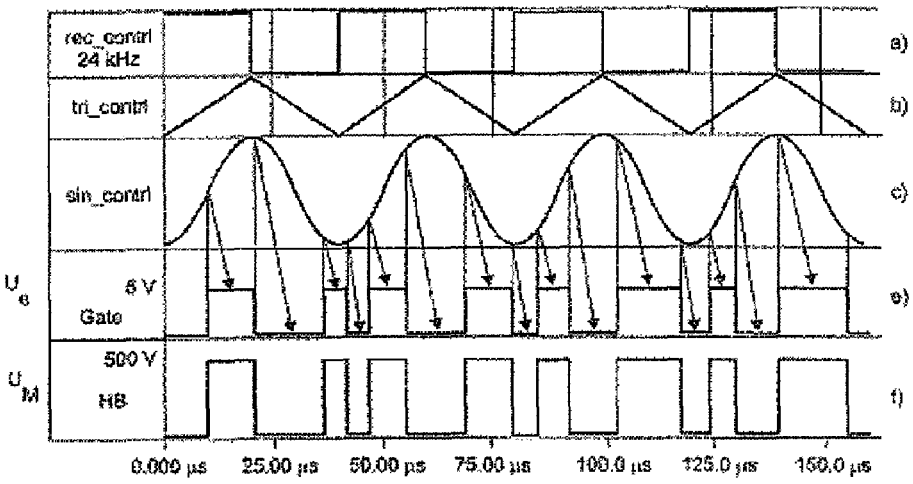
Figure 7B:
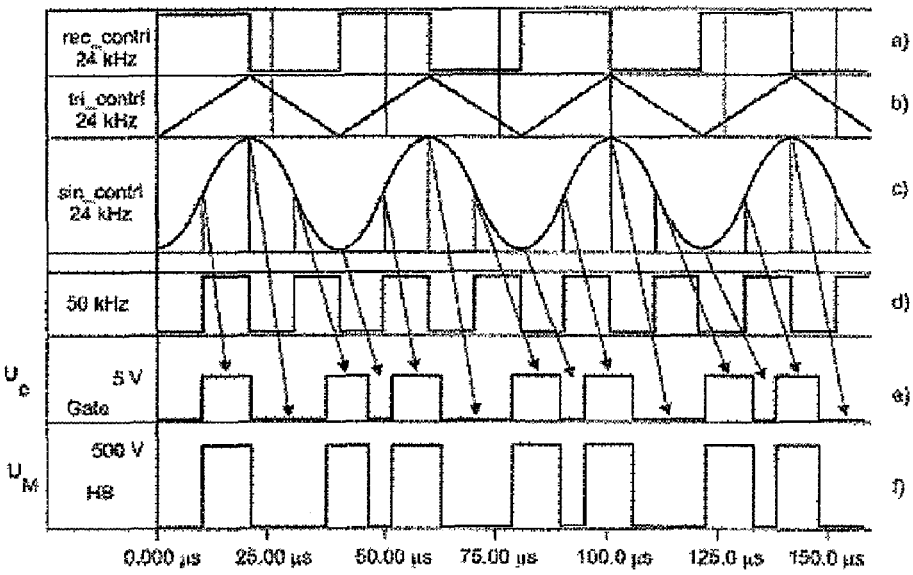
Figure 7C:
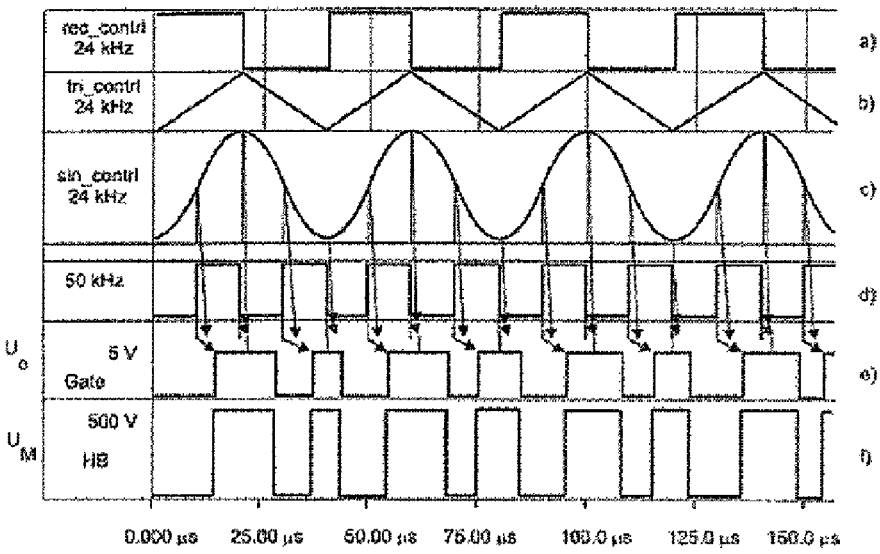
Figure 8:
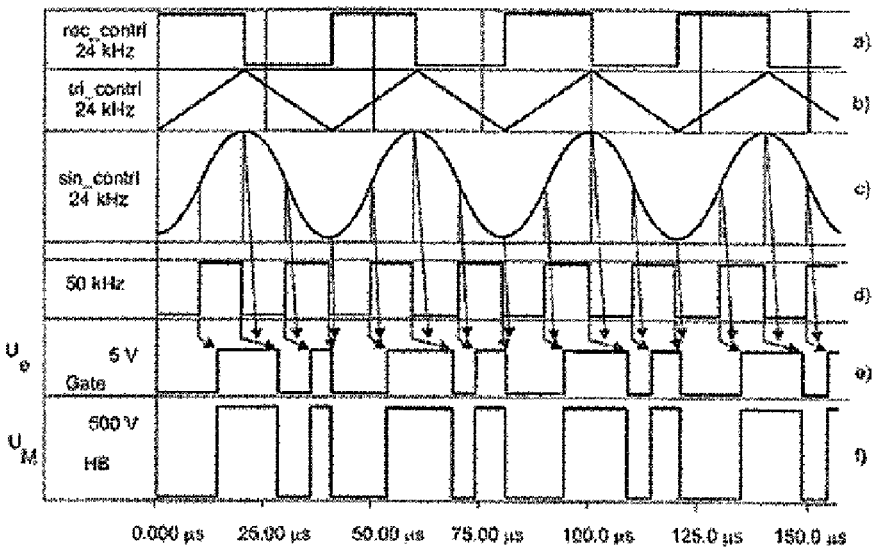
Figure 9:
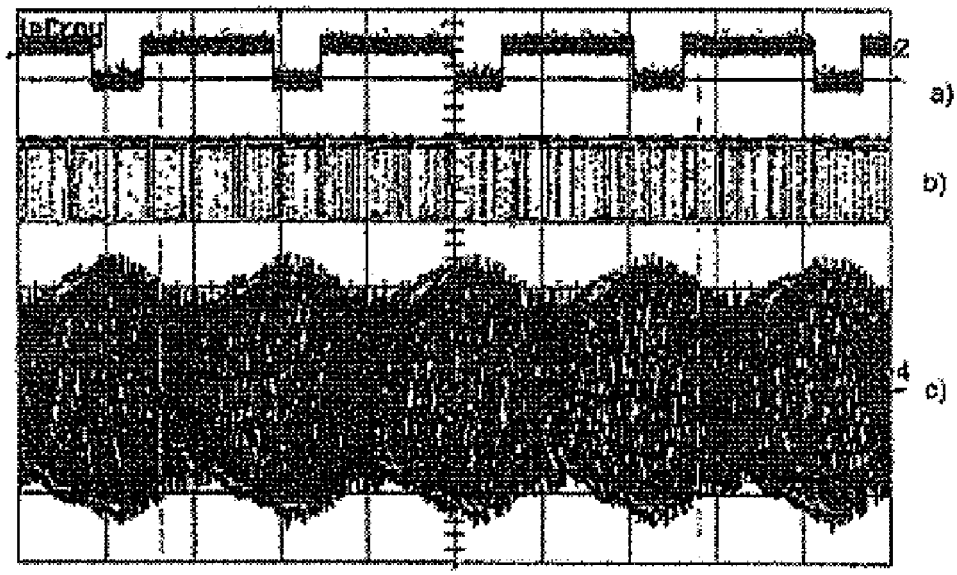

An exemplary embodiment of a circuit arrangement according to the invention will now be described in more detail below with reference to the attached drawings, in which:

FIG. 1 shows a schematic illustration of the equivalent circuit diagram of a lamp resonant circuit;

FIGS. 2*a* to *c* show the dependence of the amplitude, the power and the phase angle on the frequency for three different lamp loads;

FIG. 3*a* shows the computed amplitude spectrum for the input of the resonant circuit in the prior art; the same amplitude spectrum results at the lamp for the output of the resonant circuit;

FIG. 3*b* shows the computed power spectrum for the input of the resonant circuit in the prior art; the same power spectrum at the lamp results for the output of the resonant circuit;

FIGS. 4*a* and *d* show the computed (FIG. 4*a*) and the measured (FIG. 4*d*) amplitude spectrum for the input of the resonant circuit in the case of frequency modulation;

FIGS. 4*b* and *e* show the computed (FIG. 4*b*) and the measured (FIG. 4*e*) power spectrum for the input of the resonant circuit in the case of frequency modulation;

FIG. 4*c* shows the time profile of the signal $U_M(t)$ at the input of the lamp resonant circuit;

FIGS. 5*a* and *c* show the computed (FIG. 5*a*) and the measured (FIG. 5*c*) amplitude spectrum at the output of the resonant circuit in the case of frequency modulation;

FIGS. 5*b* and *d* show the computed (FIG. 5*b*) and the measured (FIG. 5*d*) power spectrum for the output of the load circuit at the lamp in the case of frequency modulation;

FIG. 6 shows a schematic illustration of an exemplary embodiment of a circuit arrangement according to the invention;

FIGS. 7*a* and *b* show the time profile of the drive signals and the output signals using a pulse width modulation module in the case of nonequidistant sampling (FIG. 7*a*) and equidistant sampling (FIG. 7*b*);

FIG. 7*c* shows the time profile of the drive signals and the output signals using a phase shift module and a pulse width modulation module for producing an edge shift and pulse center shift;

FIG. 8 shows the time profile of the drive signals and the output signals using a phase shift module with a shift in the edge rise and the edge drop; and FIG. 9 shows the time profile of the signal at the lamp at the output of the half-bridge arrangement measured in the persistence mode, with the amplitude modulation resulting from the frequency modulation being shown clearly.

DETAILED DESCRIPTION OF THE DRAWINGS

The inverter for operating a high-pressure discharge lamp is generally a third-order load circuit, which can be described by the following differential equation:

$$(L1*C1)\cdot\frac{d^2}{dt^2}U_a(t)+\frac{L1}{RL}\cdot\left(1+\frac{C1}{CB}\right)\cdot\frac{d}{dt}U_a(t)+U_a(t)+\left(\frac{1}{CB\cdot RL}\right)\cdot\int U_a(t)dt=U_e(t)$$

FIG. 1 shows an equivalent circuit diagram of the elements of the lamp resonant circuit including the high-pressure discharge lamp, where $U_e(t)$ is the voltage provided by the inverter, $U_a(t)$ is the voltage produced at the high-pressure discharge lamp, $L_1$ and $C_1$ are the lamp inductor and the capacitor of the load circuit, $C_B$ is a coupling capacitor, and $R_L$ is the representative nonreactive resistance of the high-pressure discharge lamp La.

In other words, excitation of the lamp load circuit $L_1$ $C_1$ with a signal $U_e(t)$ at the lamp La produces an output signal $U_a(t)$, which is filtered and damped, corresponding to the frequency characteristic and the transmission response of the load circuit, respectively. The frequency transmission characteristic of the load circuit is illustrated in FIGS. 2*a* to 2*c* for the output voltage $U_a(t)$ (FIG. 2*a*), the output power $P_{aL}$ (FIG. 2*b*) and for the phase angle phi (FIG. 2*c*), wherein, for the present application, the transmission maximum is typically slightly below the region of 26 kHz. The angle phi accordingly gives the phase difference between the input voltage $U_e(t)$ and the output voltage $U_a(t)$.

In order to implement the procedure in the present invention, in this case it is assumed that the frequency characteristic of the load circuit is designed in such a way that the transmission maximum is typically just below the region of 26 kHz. Thus, when the modulated square-wave voltage signal is impressed, first of all the carrier frequency, which is swept between 45 kHz and 55 kHz, and the sidebands thereof are transmitted sufficiently well at approximately 26 kHz and at 74 kHz, respectively, as a result of which the lamp can be kept in its operating mode.

An AC signal which has been amplitude-modulated on the input side can be described by the following function:

$$U_e(t)=(1+m\cdot\sin(2\cdot\pi\cdot f_{mod}\cdot t)\cdot Uo\cdot\sin(2\cdot\pi\cdot f_c),$$

where Uo is the voltage amplitude, $f_c$ is the carrier frequency, $f_{mod}$ is the modulation frequency, and m is the degree of modulation.

The amplitude spectrum of the amplitude-modulated input voltage Ue(f) with its two sidebands is illustrated in FIG. 3*a*. FIG. 3*b* shows the associated power spectrum Pe (f). Merely in supplementary fashion, reference is made to the fact that in the case of the procedure known from the prior art, Ue(f) is equal to Ua(f), and Pe(f) is equal to Pa(f). In this case, the amplitude modulation index is approximately 0.5. The width of the frequency bands is intended to indicate a present sweep, which is between 45 kHz and 55 kHz in the amplitude spectrum and is correspondingly higher, between 90 kHz and 124 kHz, in the power spectrum. The unswept and therefore sharper lines in the power spectrum at 24 kHz and 48 kHz, as indicated by the arrows, are the results of the amplitude modulation with 24 kHz and bring about the color mixing mode in the high-pressure discharge lamp. The line at 0 kHz corresponds to the mean power converted at the lamp.

The amplitude spectrum of the frequency-modulated voltage $U_M(f)$, which is proportional to the voltage $U_e(f)$, is illustrated in FIG. 4*a* (calculated) and FIG. 4*d* (measured). The two sidebands can clearly be seen. The associated power spectrum $P_M(f)$, which is proportional to the spectrum $P_e(f)$, is illustrated in FIG. 4*b* (calculated) and FIG. 4*e* (measured).

Figures 5C, 5D:
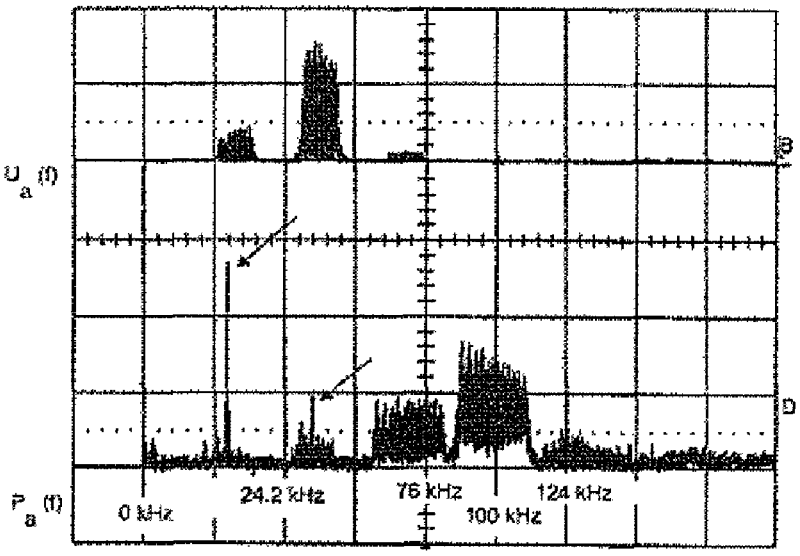

The resultant amplitude spectrum $U_a(f)$ at the output of the lamp resonant circuit is illustrated in FIG. 5*a* (calculated) and FIG. 5*c* (measured). The resultant power spectrum $P_a(f)$ after the filtering at the lamp resonant circuit is illustrated in FIG. 5*b* (calculated) and FIG. 5*d* (measured). The two sidebands and the singular modulation line at $f_{mod}$ (24 kHz) can clearly be seen.

The time profile of the signal $U_M(t)$ at the input of the lamp resonant circuit is illustrated in FIG. 4*c*.

The width of the frequency bands originates from the mentioned sweep, which is between 45 kHz and 55 kHz in the amplitude spectrum and is correspondingly higher, between 90 kHz and 124 kHz, in the power spectrum. The unswept and therefore sharper lines in the power spectrum at 24 kHz and 48 kHz, as indicated by arrows in FIGS. 5*b* and 5*d*, respectively, are the results of the amplitude modulation with 24 kHz and bring about the color mixing mode in the high-pressure discharge lamp. The line at 0 kHz corresponds to the mean power converted at the lamp.

A preferred embodiment of a digital implementation of the frequency modulation in a microcontroller is illustrated in more detail below, but each direct software implementation also results in the desired aim:

a frequency-modulated signal is generally expressed as follows:

$$U_e(t) = \frac{2}{\pi} \cdot Uo \cdot \sin(2 \cdot \pi \cdot f_c \cdot t + m \cdot \sin(2 \cdot \pi \cdot f_{mod} \cdot t)),$$

where $U_e(t)$ represents the input signal for the half-bridge;

Uo is the supply voltage for the half-bridge circuit, which is generally the so-called intermediate-circuit voltage;

$f_c$ is the carrier frequency, which in the application is typically swept between a first frequency $f_1$=45 kHz and a second frequency $f_2$=55 kHz, where the adjustment of the carrier frequency for the sweep is not important for the present consideration since the required repetition rate of approximately 100 Hz can be considered static in the application; and $f_{mod}$ is the modulation frequency, which in the application is typically 24 kHz.

The prefactor 2/π for the outer sine function is the form factor for the correction of the generally square-wave driving for the electronic switches in the half-bridge.

By deriving the argument $$\Phi(t)=2\cdot\pi\cdot f_c\cdot t+m\cdot\sin(2\cdot\pi\cdot f_{mod}\cdot t),$$

the instantaneous frequency f(t) is obtained with $$f(t) = \frac{d}{dt}\Phi(t),$$

or, when written out, $$f(t)=f_c+m\cdot(2\cdot\pi\cdot f_{mod})\cdot\cos(2\cdot\pi\cdot f_{mod}\cdot t).$$

If the degree of modulation m=to/Tc=to $f_c$ is substituted, where to is the maximum time offset of the control signal within a modulation cycle which, in a practical application, can be between 0 and Tc depending on the level of the desired degree of modulation, the frequency modulation can be rewritten as $$U_e(t)=Uo\cdot\sin(2\cdot\pi\cdot f_c\cdot to(t)\cdot\sin(2\cdot\pi\cdot f_{mod}\cdot t)).$$

Factorizing $f_c$ gives:

$$U_e(t)=Uo\cdot\sin(2\cdot\pi\cdot f_c\cdot(t+to(t)\cdot\sin(2\cdot\pi\cdot f_{mod}\cdot t))).$$

This is a representation of the frequency modulation in the form of time or phase modulation which can be converted easily in terms of software in a microcontroller.

A spectral analysis of $U_e(t)$ is generally not possible in a closed form. It is therefore necessary to work with conventional approximation solutions or to have recourse to numerical simulation methods, which gives the same result in both cases.

An analysis of $U_e(t)$ to give a Bessel series with the Jn(m) as the Bessel coefficients results in the following expression when only the first terms are taken into consideration:

$$U_e(t)=Uo\cdot Jo(m)\cdot\sin(f_c+t)+Uo\cdot 2J1(m)\cdot\sin(f_{mod}\cdot t)\cdot\cos(f_c\cdot t)+Uo\cdot J2(m)\cdot\cos(2f_{mod}\cdot t)\cdot\sin(f_c\cdot t)$$

For m<1, the following is true: $Jo(m)=1-m^2/4=1$; $J1(m)=m/2$; $J2(m)=m^2/4$.

Thus, the following results for $U_e(t)$:

$$U_e(t)=Uo\cdot\sin(f_c\cdot t)+Uo\cdot m\cdot\sin(f_{mod}\cdot t)\cdot\cos(f_c\cdot t)+Uo\cdot m^2/4\cdot\cos(2\cdot f_{mod}\cdot t)\cdot\sin(f_c\cdot t).$$

$U_e(t)$ therefore includes three terms:

the first term corresponds to a pure carrier signal at the frequency $f_c$;

the second term corresponds to two pure sidebands at the frequencies ($f_c+f_{mod}$) and ($f_c-f_{mod}$), without its carrier at the frequency $f_c$;

the third term corresponds to two pure sidebands with a low intensity at the frequencies ($f_c+2\cdot f_{mod}$) and ($f_c-2\cdot f_{mod}$) without the carrier frequency $f_c$.

The amplitude spectrum of the frequency-modulated input signal of constant amplitude and constant modulation frequency therefore corresponds to the single-tone FM characteristic. It is a carrier signal at the frequency $f_c$, whose sidebands appear at the intervals $f_{mod}$, $2\cdot f_{mod}$ to $n\cdot f_{mod}$, but the intensity of these sidebands decreases in accordance with the Bessel coefficients Jn(m).

The filter characteristic of the resonant circuit now needs to be designed in such a way that, firstly, the required frequency range covered by the resonant circuit is transmitted corresponding to the desired modulation depth, and secondly the damping for relatively high frequencies primarily over 100 kHz is sufficient for the higher-order sidebands generated by the single-tone FM to be largely filtered out, i.e. ultimately essentially only the two sidebands of the first order are used at 26 kHz and at 76 kHz.

In general, it should be noted that the amplitude spectrum is identical at the input of the resonant circuit and at the output of the resonant circuit at the lamp both in the case of the "conventional" amplitude modulation known from the prior art and in the case of the "frequency modulation" according to the invention.

The power spectrum at the input of the resonant circuit, however, is only identical to the power spectrum at the output of the resonant circuit at the lamp in the case of the "conventional" amplitude modulation method known from the prior art.

With the procedure according to the invention, the power spectrum at the input of the resonant circuit is not identical to the power spectrum at the output of the resonant circuit.

In the calculated spectra, for reasons of clarity only the fundamentals are taken into consideration, while the higher harmonics from the square-wave drive signals are not illustrated. The broadening of the spectral ranges originates from the sweep range which is covered slowly, typically between 45 kHz and 55 kHz at a sweep repetition rate of approximately 100 Hz.

FIG. 4*a* shows the calculated amplitude spectrum, and FIG. 4*d* shows the associated measured amplitude spectrum of the frequency-modulated half-bridge input signal (cf. FIG. 6). The components at the frequency $f_c$ and at the frequencies $f_c+f_{mod}$ and $f_c-f_{mod}$ are clearly shown. FIG. 4*b* shows the calculated power spectrum of the signal at the half-bridge input, and FIG. 4*e* shows the associated calculated power spectrum. As can clearly be seen, there is no singular modulation line at 24 kHz. FIG. 4*c* shows the time profile of the half-bridge input signal. As has already been noted, $U_M$ is proportional to $U_e$.

FIG. 5*a* shows the calculated amplitude spectrum, and FIG. 5*c* shows the associated measured amplitude spectrum Ua(f) of the output signal Ua(t) at the lamp.

FIG. 5*b* shows the calculated power spectrum Pa(f) at the lamp, and FIG. 5*d* shows the associated measured power spectrum at the lamp. The narrow spectral lines which can be seen in the power spectrum indicate the sharp individual lines of the modulation.

Modulation depths of up to 50% can be achieved by designing the filter characteristic of the load circuit.

As an intermediate result it can be established that the desired modulation for the operation of a high-pressure discharge lamp can be produced merely on the basis of the drive signals for the electronic switches of the half-bridge by means of a microcontroller, without any additional electronic power components.

FIG. 6 shows an exemplary embodiment of a circuit arrangement according to the invention. In this case, a so-called lamp inverter 10 comprises an inverter 12, which comprises a first switch S1 and a second switch S2 in a half-bridge arrangement, which switches are driven via their control inputs by a voltage $U_{e1}$ and $U_{e2}$, respectively, where $U_{e1}$ and $U_{e2}$ are always complementary with respect to one another and can be represented in terms of signals by an input signal $U_e(t)$.

The lamp inverter 10 furthermore comprises a load circuit or a resonant circuit 14, which comprises an inductor $L_1$ and a capacitor $C_1$. The half-bridge arrangement is supplied by a supply voltage Uo, which generally represents the so-called intermediate-circuit voltage.

In the exemplary embodiment illustrated, the input signal $U_e$ of the lamp inverter 10, from which the voltages $U_{e1}$ and $U_{e2}$ are derived via a driver circuit 16, is made available by a microcontroller 18. In this case, reference is made to the fact that the elements of the microcontroller 18 could also be designed to be discrete. In the microcontroller 18, the voltage $U_{R2}$, i.e. the voltage drop across the resistor $R_2$ of the voltage divider $R_1$, $R_2$, is supplied via the input 20 of said microcontroller.

The voltage $U_{R2}$ is proportional to the voltage $U_a$ at the lamp La and makes it possible to measure the amplitude of the lamp voltage and the degree of amplitude modulation. The voltage $U_{R2}$ is firstly supplied to a low-pass filter, comprising a capacitor $C_P$ and a resistor $R_P$, in order to generate a voltage $U_P$ which is proportional to the mean value of the output voltage $U_a$.

Secondly, the voltage $U_{R2}$ is supplied to a high-pass filter network 22 and rectified at a diode, as a result of which the present degree of modulation fluctuation $\Delta U_{act}$ is produced. The present value of the degree of modulation can be determined from the two measured variables by $$m_{act}=\Delta U_{act}/U_P.$$

The setpoint value $m_{set}$ of the degree of modulation can be input via an interface 24. This setpoint value is multiplied by $U_P$ in a multiplier 26 and therefore a $\Delta U_{set}$ is provided at the output of said multiplier. A controller 28 carries out closed-loop control in such a way that $\Delta U_{act}=\Delta U_{set}$.

Then, a controlled variable is provided at the output of the controller 28 as a manipulated variable for the degree of modulation and supplied to a block 30. This block 30 furthermore receives a sinusoidal signal at the frequency $f_{mod}$=24 kHz from a 24 kHz generator 32. A 24 kHz signal, whose amplitude is subjected to closed-loop control and corresponds to the desired degree of modulation $m_{set}$, is provided at the output of the block 30.

The 100 Hz sweep signal is generated as a saw-tooth signal via a frequency generator 34. Both the saw-tooth sweep signal and the 24 kHz signal with controlled amplitude are made available to a frequency generator 36. This frequency generator processes the two input signals, i.e. the saw-tooth sweep signal at the input 38 and the amplitude-controlled $f_{mod}$ signal at the input 40, to give the signal $U_e$, which as a result is a signal which has been frequency-modulated with the sinusoidal clock timing of $f_{mod}$ and whose mean frequency in comparison with $f_{mod}$ is adjusted in saw-tooth form much more slowly with the 100 Hz clock timing of the sweep control signal.

As is obvious to a person skilled in the art, the coupling capacitor $C_{La}$, which is used for blocking the DC component originating from the half-bridge, can also be fitted at another point, for example between the lamp inductor $L_1$ and the lamp La, between the lamp La and the connection terminal for the voltage Uo etc. Furthermore, an embodiment with a transformer in the output circuit is likewise possible if DC-decoupling of the lamp is desired.

FIGS. 7*a* to *c* and FIG. 8 show the generation of the voltage $U_e$ in accordance with four different variants of the present invention.

The respective curve a) represents a square-wave signal with the frequency $f_{mod}$, in this case 24 kHz. In accordance with the respective curve b), first a triangular-waveform signal is derived from this square-wave signal in the microcontroller and a sinusoidal signal is derived from said triangular-waveform signal; see the respective curve c). The four variants differ in terms of the curves e) and f), with a 50 kHz signal, i.e. the mean frequency of the swept carrier frequency, in the case of three curves being illustrated as curve d), which is of further significance when generating the desired signals. Curve e) represents the respective voltage $U_e(t)$ as the half-bridge drive signal at a 5 V level, and the respective curve f) represents the voltage $U_M$, with the same form as curve e), as the half-bridge center point M, which is at a level of approximately 500 V.

FIGS. 7*a* to 7*c* show embodiments in which a pulse width modulation module is used whose clock input is coupled to a source for the clock which is swept between the first and the second frequency, and whose modulation input is coupled to a source for the signal at the modulation frequency, the drive circuit 18 being designed to modulate the pulse width of the signal which is swept between the first and the second frequency as a function of the signal at the modulation frequency, in particular as a function of an instantaneous value of the signal at the modulation frequency.

FIG. 7*a* shows an example of nonequidistant sampling. In this case, the pulse width of the swept signal with the frequency $f_c$ is set after each edge change corresponding to the instantaneous value of the periodic modulation signal $f_{mod}$, see curve c). A low amplitude of the modulation signal, curve c), therefore results in a small pulse width, and a high amplitude of the modulation signal results in a large pulse width. Once the corresponding pulse width has elapsed, the next pulse width is fixed in accordance with the then present instantaneous value of the sinusoidal signal, curve c).

In accordance with the variant illustrated in FIG. 7*b*, the drive circuit 18 is designed to modulate the pulse width of the clock which is swept between the first and the second frequency as a function of an instantaneous value of the signal at the modulation frequency in such a way that, at predeterminable times, in particular at times with an equidistant time interval, the instantaneous value of the signal at the modulation frequency is determined and, corresponding to the determined instantaneous value, the instantaneous pulse width of the swept clock is lengthened or shortened. In this case, the higher the sampling rate is selected to be, the more perfectly the frequency modulation can be introduced by means of a change in the pulse width, but also the more often the microcontroller needs to clock out, as a result of which at some point its limit, predetermined by the specification, would naturally be reached. Therefore, in practice preferably only a sampling rate of $2 \cdot f_c$ is used, which is sufficient in terms of accuracy to modulate a 24 kHz sinusoidal signal (oversampled 4 times) into a 50 kHz clock (oversampled twice).

If the precisely modulated swept clock synchronous sampling at $2f_c$ is then used, the Shannon criterion for writing a signal with the clock timing at the frequency $f_c$ is always maintained and is particularly advantageous from this point of view.

FIG. 7*b* shows the time profiles in the case of equidistant sampling: the pulse width of the frequency-modulated signal with the frequency $f_c$ is set equidistantly with the clock timing of a sufficiently large master signal, curve c), in this case 50 kHz, corresponding to the instantaneous value of the periodic modulation signal $f_{mod}$. In this case, the profile of the voltage $U_e$, curve e), is determined as follows: at each rising and falling edge of the master signal in curve d), the instantaneous value of the sinusoidal signal, curve c), is determined and is used to produce the signal $U_e$, curve e).

FIG. 7*c* shows an embodiment in which, in the first and in the second drive signal, both the rising edge and the pulse center are shifted with the clock timing of the modulation frequency with respect to the unmodulated clock which is swept between the first and the second frequency. In this case, the edge rise of the frequency-modulated signal, curve e), is shifted equidistantly with the clock timing of a sufficiently large master signal, curve d), corresponding to the instantaneous value of the periodic modulation signal $f_{mod}$, curve c). Then, the pulse width is calculated corresponding to this representative modulation value in such a way that the pulse center is shifted in terms of absolute value by half with respect to the unmodulated pulse.

FIG. 8 shows an embodiment in which the drive circuit comprises a phase shift module, whose clock input is coupled to a source for the clock which is swept between the first and the second frequency, and whose modulation input is coupled to a source for the signal at the third frequency, the drive circuit being designed to shift the start edge of the signal which is swept between the first and the second frequency as a function of the signal at the modulation frequency, in particular as a function of an instantaneous value of the signal at the modulation frequency.

As shown in FIG. 8, the edge rise and the edge fall of the frequency-modulated signal, curve e), is in this case shifted equidistantly with the clock timing of a sufficiently large master signal, curve d), corresponding to the instantaneous value of the periodic modulation signal $f_{mod}$, curve c).

FIG. 9 shows the measured time profiles of different signals with a test setup, in which the present invention has been used. In this case, the voltage at the output of the load circuit, i.e. the voltage with which the lamp is driven, has been measured in the persistence mode. Curve a) shows the time profile of the modulation signal, curve b) shows the frequency-modulated square-wave signal at the input of the resonant circuit, i.e. at the center point M of the half-bridge arrangement, and curve c) shows the voltage Ua at the lamp La at the output of the resonant circuit. The amplitude modulation with the frequency $f_{mod}$ can clearly be seen.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A circuit arrangement for operating a high-pressure discharge lamp, comprising:

at least one first electronic switch and one second electronic switch in a half-bridge arrangement;

a supply voltage terminal for supplying the half-bridge arrangement with a DC voltage signal;

a load circuit, which comprises a lamp inductor and is coupled firstly to the half-bridge center point and secondly to at least one terminal for connecting the high-pressure discharge lamp;

a drive circuit for providing at least one first and one second drive signal for the at least one first electronic switch and the second electronic switch, the drive circuit being configured to provide the first and the second drive signal such that a clock thereof is firstly swept between a first and a second frequency;

wherein the drive circuit is furthermore configured to modulate the first and the second drive signals with a predetermined third frequency, with the modulation with the predetermined third frequency being single-tone frequency modulation, selected so that, in an amplitude spectrum of the first and the second drive signals, at least one first, one second and one third spectral line appear, the first spectral line corresponding to an instantaneous frequency of the swept clock, and the second and the third spectral lines, in terms of absolute value, appearing at an interval with respect to the predetermined third frequency, symmetrically with respect to the first spectral line, and so that, in a power spectrum of the signal, at the at least one terminal for connecting the high-pressure discharge lamp, there is a spectral line at the predetermined third frequency.

2. The circuit arrangement as claimed in claim 1, wherein the clock frequency is below 150 kHz.

3. The circuit arrangement as claimed in claim 1, wherein the third frequency is below 50 kHz.

4. The circuit arrangement as claimed claim 1, wherein the sweep frequency is between 50 Hz and 500 Hz.

5. The circuit arrangement as claimed in claim 1, wherein only one first electronic switch and one second electronic switch are provided in the half-bridge arrangement.

6. The circuit arrangement as claimed in claim 1, further comprising a third and a fourth electronic switch, the first, the second, the third and the fourth electronic switches being connected in a full-bridge arrangement, and the drive circuit being configured to also provide the drive signals for the third and the fourth electronic switches corresponding to the drive signals for the first and the second electronic switches.

7. The circuit arrangement as claimed in claim 1, wherein the drive circuit comprises a controlled oscillator.

8. The circuit arrangement as claimed in claim 7, wherein the drive circuit comprises a pulse width modulation module, having a clock input that is coupled to a source for the clock which is swept between the first and the second frequency, and having a modulation input that is coupled to a source for the signal at the third frequency, the drive circuit being configured to modulate a pulse width of the signal which is swept between the first and the second frequency as a function of a signal at the third frequency.

9. The circuit arrangement as claimed in claim 8, wherein the drive circuit is adapted to modulate the pulse width of the signal which is swept between the first and the second frequency as a function of an instantaneous value of the signal at the third frequency.

10. The circuit arrangement as claimed in claim 9, wherein the drive circuit is configured to modulate the pulse width of the clock which is swept between the first and the second frequency as a function of an instantaneous value of the signal at the third frequency such that, at predeterminable times, the instantaneous value of the signal at the third frequency is determined and, corresponding to the determined instantaneous value, an instantaneous pulse width of the swept clock is lengthened or shortened.

11. The circuit arrangement as claimed in claim 10, wherein, in the first and in the second drive signals, both a rising edge and a pulse center are shifted with a clock timing of the third frequency with respect to an unmodulated clock which is swept between the first and the second frequency.

12. The circuit arrangement as claimed in claim 7, wherein the drive circuit comprises a phase shift module, having a clock input that is coupled to a source for the clock which is swept between the first and the second frequency, and having a modulation input that is coupled to a source for a signal at the third frequency, the drive circuit being configured to shift a start edge and an end edge of the signal which is swept between the first and the second frequency as a function of the signal at the third frequency.

13. A method for operating a high-pressure discharge lamp having a circuit arrangement with at least one first electronic switch and one second electronic switch in a half-bridge arrangement, a supply voltage terminal for supplying the half-bridge arrangement with a DC voltage signal, a load circuit, which comprises a lamp inductor and is coupled firstly to the half-bridge center point and secondly to at least one terminal for connecting the high-pressure discharge lamp, a drive circuit for providing at least one first and one second drive signal for the first electronic switch and the second electronic switch, the drive circuit being configured to provide the first and the second drive signal such that the clock thereof is firstly swept between a first and a second frequency, the method comprising:

implementing a single-tone frequency modulation of the first and second drive signals with the predetermined third frequency selected so that, in a power spectrum of the signal, at the at least one terminal for connecting the high-pressure discharge lamp, there is a spectral line at the third predetermined frequency.

* * * * *